US005182844A

United States Patent [19]

Honda

[11] Patent Number: 5,182,844

[45] Date of Patent: Feb. 2, 1993

[54] METHOD OF PRODUCING A STUFFED DOLL

[76] Inventor: Akito Honda, 21-15; Okusawa 5-chome, Setagaya-Ku, Tokyo, Japan

[21] Appl. No.: 860,024

[22] Filed: Mar. 30, 1992

[51] Int. Cl.[5] ..... A63H 3/02; A63H 3/36

[52] U.S. Cl. ..... 29/469; 29/805; 446/372; 446/391

[58] Field of Search ..... 446/369, 372, 391; 29/428, 469, 805

[56] References Cited

U.S. PATENT DOCUMENTS

| | | | |
|---|---|---|---|
| 1,282,004 | 10/1918 | Shearer | 446/391 |
| 1,583,408 | 5/1926 | Mackay | 446/372 |
| 1,790,872 | 2/1931 | McBee | 446/372 |
| 1,948,803 | 2/1934 | Sherrill | 446/372 |
| 2,111,150 | 3/1938 | Marcus | 29/805 |
| 2,391,131 | 12/1945 | Clark | 446/372 |
| 2,483,325 | 9/1949 | Sanders et al. | 446/372 |
| 4,591,521 | 5/1986 | Freno et al. | 446/372 |
| 4,629,441 | 12/1986 | Cahill | 446/372 |
| 4,659,319 | 4/1987 | Blair | 446/391 |
| 4,892,501 | 1/1990 | Girelli | 446/372 |

FOREIGN PATENT DOCUMENTS

| | | | |
|---|---|---|---|
| 728322 | 10/1942 | Fed. Rep. of Germany | 446/391 |
| 52776 | 2/1937 | Fed. Rep. of Germany | 446/391 |
| 63-72 | 1/1988 | Japan . | |
| 8808321 | 11/1988 | World Int. Prop. O. | 446/372 |

OTHER PUBLICATIONS

Mashburn & Baird, Instruction Book Published by Plaid Enterprises, Inc. 1981.

*Primary Examiner*—William E. Terrell
*Attorney, Agent, or Firm*—Oliff & Berridge

[57] ABSTRACT

Disclosed is a method of producing a stuffed doll which comprises the steps of: forming elastic cloth such as rib stitch cloth, interlock stitch cloth or the like into a bag-like member; inserting shaping members formed in shapes of a forehead and a chin into the bag-like member to its inside upper and lower portions respectively; filling the bag-like member with stuffing to thereby form a head base having a predetermined shape; fixing long-haired hair members, eyebrow members, eye members, a nose member, and a mouth member on the head base to thereby form a head portion; and fixing the head portion on a body portion.

6 Claims, 10 Drawing Sheets

METHOD OF PRODUCING A STUFFED DOLL

BACKGROUND OF THE INVENTION

1. Field of the Invention

The present invention relates to a method of producing stuffed dolls which simulate human beings.

2. Description of the Prior Art

Generally, the term "stuffed toy" means a stuffed toy simulating an animal such as a dog, a cat, a rabbit, a bear, or the like. Recently, however, stuffed toys simulating human beings, that is, stuffed dolls, have appeared, and, particularly, stuffed dolls having faces simulating specific persons have been popular. As disclosed in Japanese Patent No. 1470149, such stuffed dolls are produced by a method in which parts such as eyebrows, eyes, a nose, a mouth, etc. are previously prepared for every type of face and those parts are sewn or bonded onto a head base to thereby form a face of a man. In this technique, the head base is formed merely in a manner that cloth is formed bag-like so as to be filled with stuffing such as kapok or the like, and the unevenness of the face is realized by adjusting the state of filling of the stuffing. Unlike the case of animals, however, in the case of human faces, the surface unevenness is considerably different between the Orientals and Europeans. Particularly in the respective parts of a forehead, a nose, and a chin, the European has well-defined features so that the unevenness of the face is so conspicuous to make it difficult to express the unevenness of the face well by simply adjusting the state of filling of the stuffing. There has been a further disadvantage that since the eyebrows are made of a felt material, they are generally flat and give no feeling of hair growth.

SUMMARY OF THE INVENTION

It is therefore an object of the present invention to provide a method of producing a stuffed doll simulating a human being in which the unevenness on the forehead and chin of the face, particularly in the case of a European, can be expressed efficiently.

It is another object of the present invention to provide a method of producing such a stuffed doll as mentioned above, in which eyebrows can be finished easily and finely.

It a further object of the present invention to provide a method of producing such a stuffed doll as mentioned above, in which a nose is made high effectively.

In addressing the above problems, according to an aspect of the present invention, the method of producing a stuffed doll comprises the steps of: forming elastic cloth such as rib stitch cloth, interlock stitch cloth or the like into a bag-like member; inserting shaping members formed in shapes of a forehead and a chin into the bag-like member to its inside upper and lower portions respectively; filling the bag-like member with stuffing to thereby form a head base having a predetermined shape; fixing long-haired hair members, eyebrow members, eye members, a nose member, and a mouth member on the head base to thereby form a head portion; and fixing the head portion on a body portion.

The forehead and chin of the head base are formed of a shaping member respectively so that it is possible to form intoned or modulated shapes unlike the case of shaping only with stuffing.

Further, the shaping member may be constituted by a bag-like pad member (hereinafter simply referred to as "pad member"). For example, a shoulder pad member generally used for ordinary clothes may be used as the shaping member, so that the shaping member can be easily obtained.

Additionally, in the case where the shaping member is formed like a bag so as to be filled with a stuffing material, it is possible to simply obtain a shaping member which can emphasize the chin.

The shaping member may be made of a rubber or plastic elastic body.

Next, the eyebrows may be formed by cutting a suitable material, for example, Magic Tape (trade name) so that they may give a feeling of hair growth a little more than the case of using a felt material to thereby improve reality. Further, being firmer than felt, Magic Tape (trade name) can be dyed with color spray.

Further, the nose may be formed by use of paper clay as a core material in such a manner that a shaping material such as kapok, cotton, or the like is properly put over the paper clay, and then the shaping material is covered with the same material as that of the head base. In this case, a high nose can be efficiently made and the nose never gets out of shape.

DETAILED DESCRIPTION OF THE PREFERRED EMBODIMENT

Here, description will be made about an embodiment in the case where a stuffed doll with well-defined features is produced. The stuffed doll is constituted by a body portion, a head portion, a hair portion, and a face portion. In producing the stuffed doll, the following materials are prepared.

(a) Head portion:

(1) White or skin-colored cloth for a head portion base (elastic cloth, such as, rib stitch or interlock stitch of cotton, wool, polyester, nylon, acryl, or the like; for example interlock fabric);

(2) Stuffing (kapok, cotton, or the like); and (3) A pad member.

(b) Hair:

(1) Pile fabric having long hair and colored in black, brown, gray, gold, or the like; and (2) Stuffing.

(c) Face portion:

(1) Eyebrows: Magic Tape (trade name) (or pile fabric);

(2) Eyes: buttons, felt;

(3) Nose: the same cloth as that for the head base, paper clay, and kapok, or cotton;

(4) Mouth: felt; and (5) Ear: the same cloth as that for the head base, and kapok or cotton.

(d) Body portion:

The seam cloth as that for the head portion base, and stuffing.

Next, a method of producing a stuffed doll by use of the materials described above will be specifically described hereunder.

Figure 1:
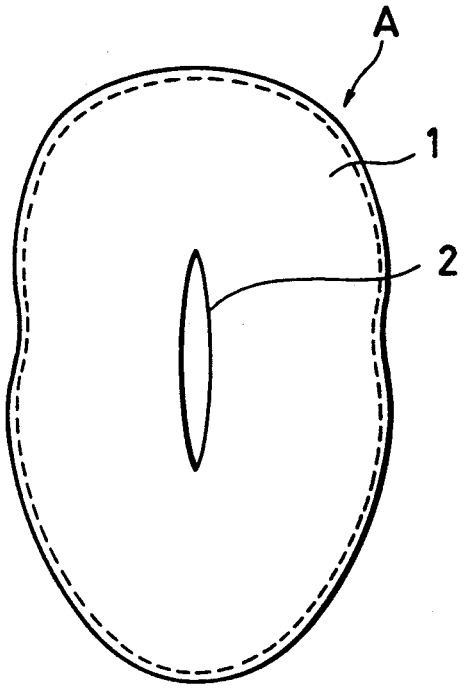
FIG. 1 includes front views (a) and (b) each showing the foundation of the method of producing a head base.
Figure 1:
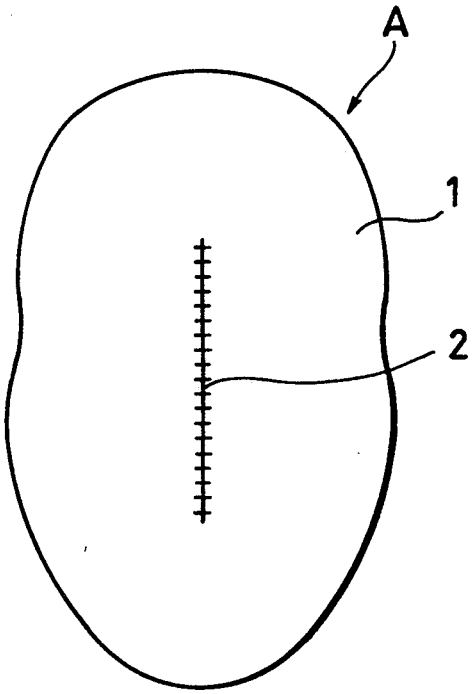
Figure 2:
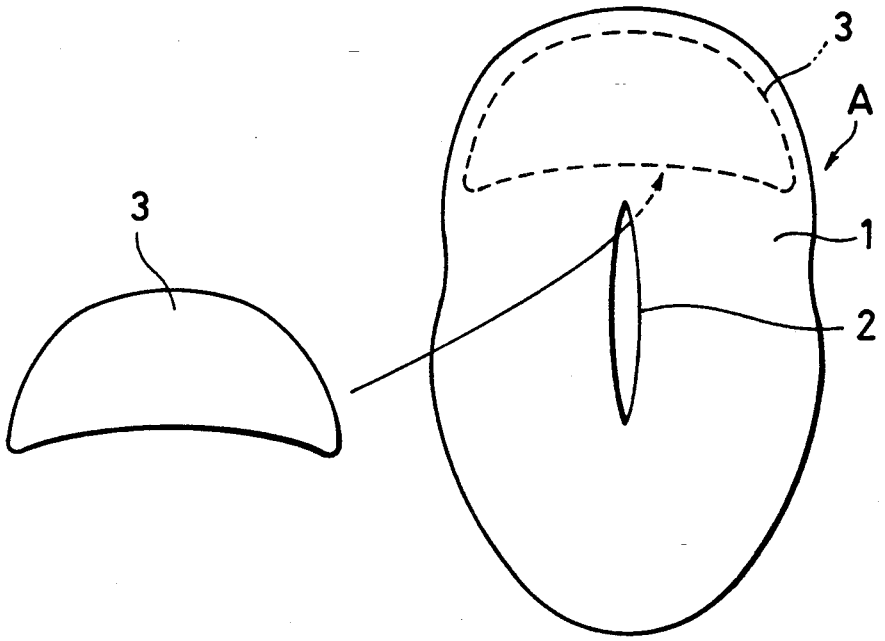
FIG. 2 is a front view showing a manner how to form the head base for shaping a forehead.
Figure 3:
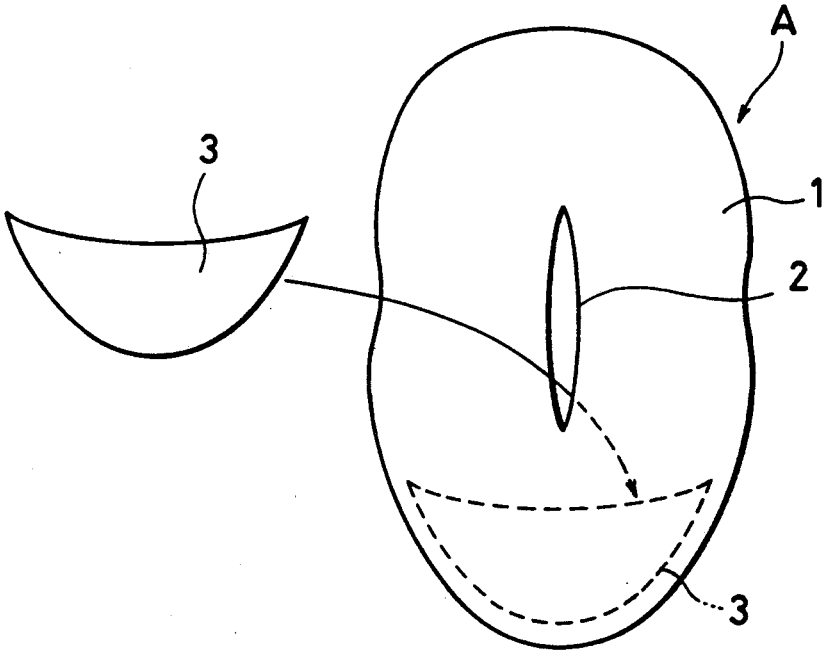
FIG. 3 is a front view showing a manner how to form the head base for shaping a chin.

First, when the head portion is formed, as shown in (a) of FIG. 1, two pieces of cloth (interlock fabric) 1 for a head base A are sewn to each other in accordance with a predetermined pattern and the sewn pieces of cloth are cut along a margin to sew up, and then a slit 2 of 5–7 cm is formed in one of the two pieces of cloth at its center portion. After the whole of the two pieces cloth are turned inside out through the slit 2, the inside is filled with a stuffing material. In this case, as shown in FIGS. 2 and 3, pad members 3, as shaping members, are inserted into the head base A at forehead and chin portions respectively, and then the respective insides of the pad members 3 are filled with a stuffing material 4. After the whole shape has been adjusted, the slit 2 is sewn together as shown in (b) of FIG. 1.

Figure 4:
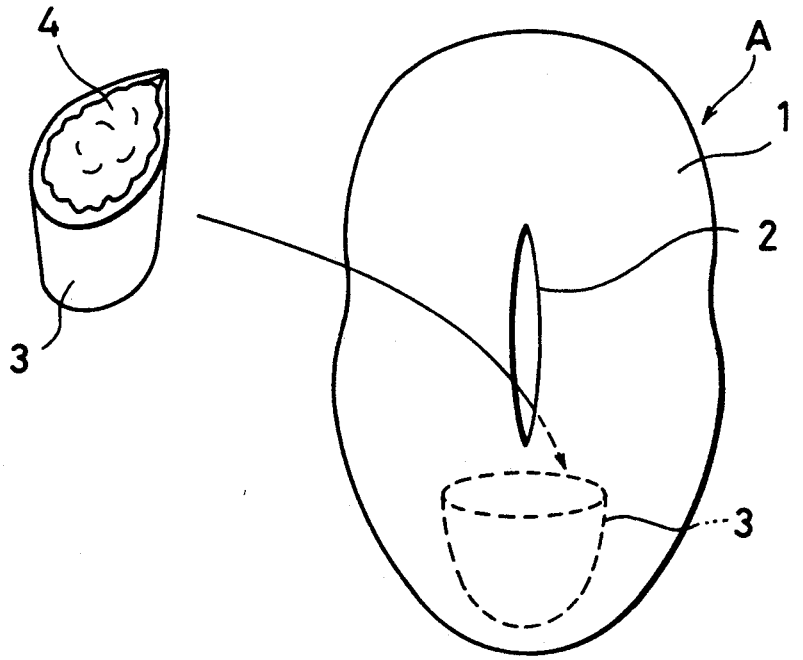
FIG. 4 is a front view showing a manner how to form the head base for particularly emphasizing a chin.

In the case where the pad member 3 is put on the chin portion, if it is necessary to more emphasize the state of outward projection of the chin, it will do to form the pad member 3 such that the pad member 3 is sewn at its opposite sides as shown in FIG. 4, and after filled with the stuffing material 4, the pad member 3 is put into the head base A.

As described above, the cloth 1 of the head base A is elastical so that the unevenness of a face can be expressed to a some extent by adjusting the stuffed state of the inside stuffing, that is, by making the stuffing little in some portions and much in other portions. Since the stuffing is however composed of kapok or cotton which is so elastic, the uneven state can not be made so desiredly by adjusting the density. On the other hand, the pad member 3 is originally made of densely compressed cotton or the like so that it has a firm shape in comparison with the stuffing, and it is thin at its edge portions while thick at its central portion. When the pad member 3 is combined with the stuffing, therefore, the thin edge portions may fit to the stuffing in good connecting condition while the thick central portion has no good connecting condition with the stuffing, so that the shape is emphasized out. Accordingly, the respective shapes of the forehead and chin can be expressed well.

In order to emphasize the forehead/chin, the pad member 3 is put into the head base A. Then, a needle with a thread is inserted from the backside of the head base A to pass through the cloth of the pad member 3 at the forehead/chin portion, and after catching a bit of the pad member, the needle with a thread is passed through the head base A to its backside again. Then, the thread is pulled strongly at the backside of the head base A so that the portion of the pad member 3 caught by the thread is rearward (backward) pulled to thereby emphasize the uneven state of the forehead/chin of the face.

Figure 5:
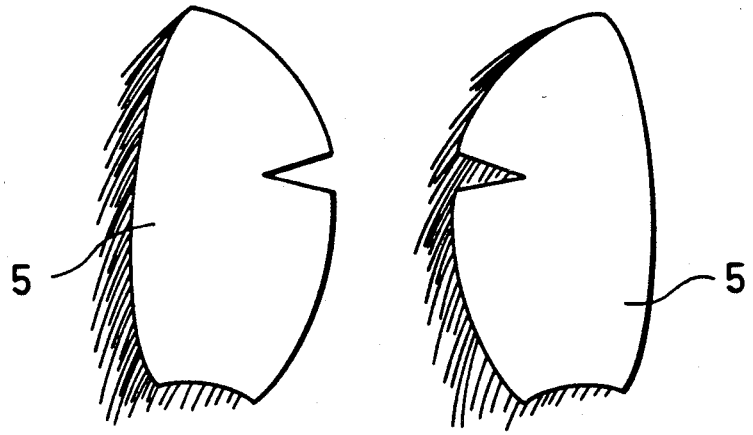
FIG. 5 includes views (a), (b), and (c) for explaining a manner how to form a hair member.
Figure 5:
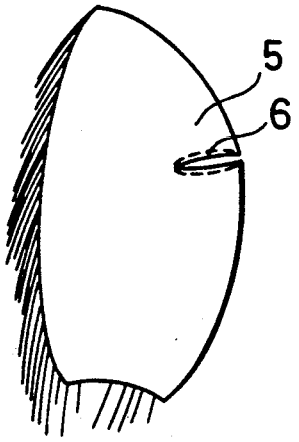
Figure 5:
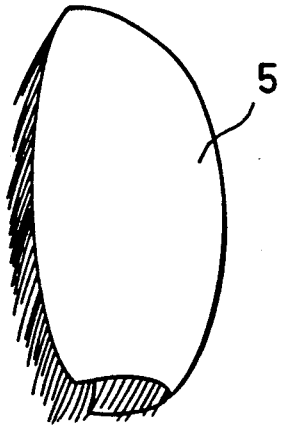

Next, when the hair is to be formed, long-hair pile cloth having a desiredly selected color is prepared, and the pile cloth is cut in accordance with a predetermined pattern of a desired hair type to thereby produce such a pair of hair members **5*a* for backside as shown in (a) of FIG. 5. The two backside hair members 5*a* are formed so as to be horizontally or left/right symmetrical to each other. As shown in (b) of FIG. 5, each dart portion 6 is sewn together. Further, as shown in (c) of FIG. 5, the two hair members 5*a* are put on each other with their front surfaces put inside and sewn to each other at the back of the head. A pair of hair members 5*b* for fore-side are prepared by cutting the pile cloth in accordance with a pattern of a desired hair type, similarly to the backside hair members 5*a***.

Figure 6:
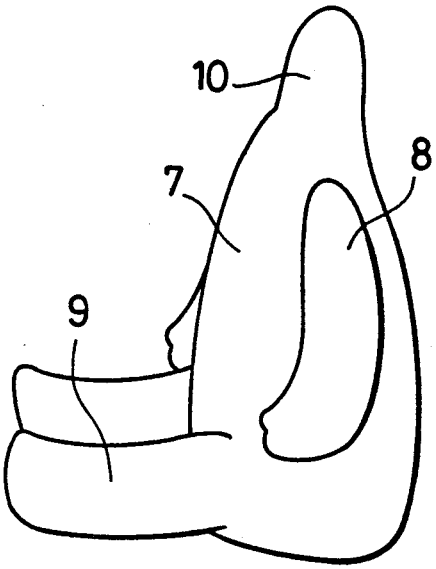
FIG. 6 is a side view showing a body portion.

In preparing a body portion, as shown in FIG. 6, the same cloth as that of the head base A is used to form a body portion 7, a pair of arm portions 8, and a pair of leg portions 9. After filled with the stuffing, the body portion 7, the arm portions 8, and the leg portions 9 are combined with each other. A neck portion 10 of the body portion 7 is projected upward.

Next, the manner how to form the face portion will be described hereunder separately as to eyebrows, eyes, a nose, and a mouth.

Figure 7:
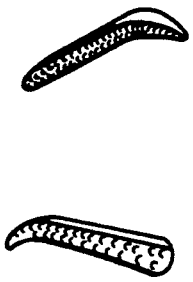
FIG. 7 is a front view of an eyebrow.

(1) The manner how to form eyebrows:

A female member of Magic Tape (trade name) (light brown, deep brown, dark brown, gray, black, or the like) is cut as shown in FIG. 7. In the case of using Magic Tape (trade name), no thread gets untiled or frayed, and not only the end surface of the eyebrow can be finely finished but the eyebrow may give a feeling of hair growth to thereby improve the feeling of reality. Alternatively, the eyebrows may be formed by cutting pile cloth.

Figure 8:
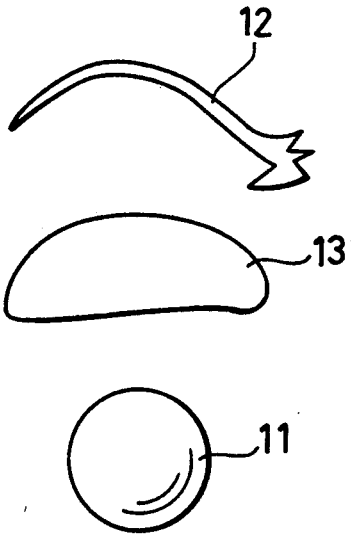
FIG. 8 is an exploded view of an eye.

(2) The manner how to form eyes:

Eyes are different between a male and a female and between individuals, and in some cases therefore eyes may be formed by use of only buttons (hereinafter referred to as "button eyes"), while in other cases, eyes may be formed by in combination of buttons and felt (hereinafter referred to as "felt eyes"). When a felt eye is to be formed, as shown in FIG. 8, a pupil is constituted by a button 11 while eyelashes or eye lines and the white of the eye are formed of pieces of felt 12 and 13. The button 11 is selected to have a color corresponding to the pupil to be formed, and similarly, the pieces of felt 12 and 13 are selected to have colors corresponding to the eyelashes or eye lines and the white of the eye. The pieces of felt 12 and 13 are cut into predetermined shapes of the eyelashes or eye lines and the white of the eye.

Figure 9:
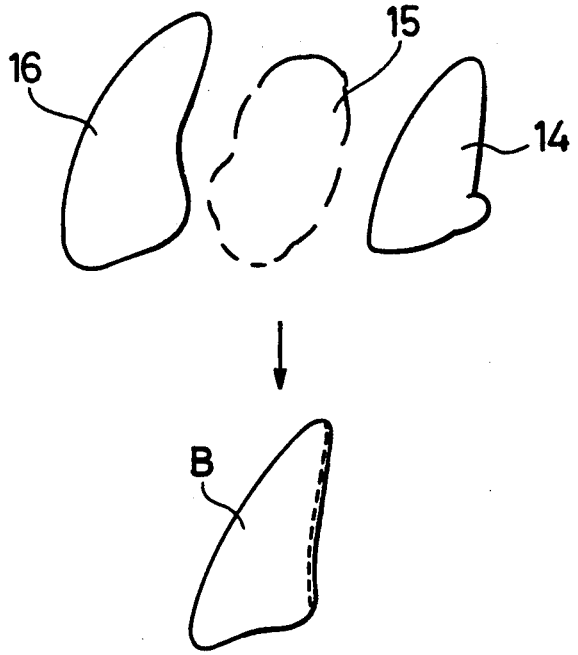
FIG. 9 is an explanatory view showing a manner how to form a nose.

(3) The manner how to form a nose:

As shown in FIG. 9, a core material 14 is made of paper clay, and pasteboard having a predetermined shape is bonded onto the core material at its back surface. Then, kapok or cotton 15 is suitably put over the core material 14 so as to suitably adjust the shape. A piece of cloth 16 the same as that of the head base A is applied to cover the kapok or cotton 15 which is covering the core material 14. Then, the cloth 16 is tightened closely so as not to generate wrinkles. As the core material 14, paper clay which is easy for working and which is properly solid is used, so that the shape with a straight nose can be expressed well. Further, there is an advantage that the core material 14 is light in weight after dried.

(4) The manner how to form a mouth:

Felt colored in a group of red is cut into the shape of lips. In the case of a man, it is preferable to form outline stitches at a predetermined position on the head base A so that a mouth is expressed with a thread.

Figure 10:
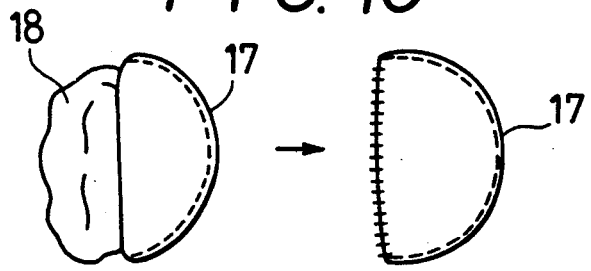
FIG. 10 is an explanatory view showing a manner how to form an ear.

(5) The manner how to form ears:

As shown in FIG. 10, two pieces of cloth 17 are prepared from the same cloth as that of the head base A in accordance with a predetermined pattern, and the two pieces of cloth are sewn to each other except a stuffing inlet 18 to thereby form a bag-like member. After sewn, the bag-like member is turned inside out, and filled with the stuffing 18 from the stuffing inlet. Then, the stuffing inlet is folded inward and sewn together so as to be closed.

Next, the manner how to attach the parts of the face and the hair members to the head base A will be described hereunder.

Figure 11:
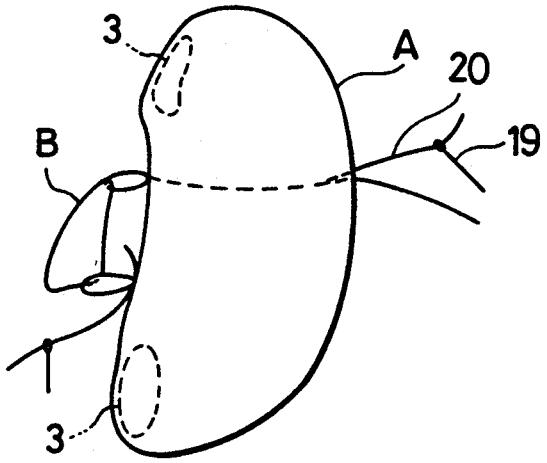
FIG. 11 is an explanatory view showing a manner how to attach the nose to the head base.

First, as shown in FIG. 11, a needle 19 with a thread 20 is made to pass through the head base A from its backside so as to make the needle 19 come out to a predetermined position on the face portion. Then, after catching a bit of the upper end portion of the nose B, the needle 19 is made to pass through the head base A to its backside again, and then the thread 20 is knotted to thereby fix the upper portion of the nose B. The lower portion of the nose B is fixed on the face portion by vertical blind stitching.

The eyes are positioned so as to be harmonious with the position of the nose B. In the case of attaching a button eye, similarly to the case of the nose, a needle with a thread is made to pass through the head base A from its backside so as to pass through a button hole. Then, the needle is made to return to the backside of the head base A again, and the thread is knotted so as to fix the button eye.

Figure 12:
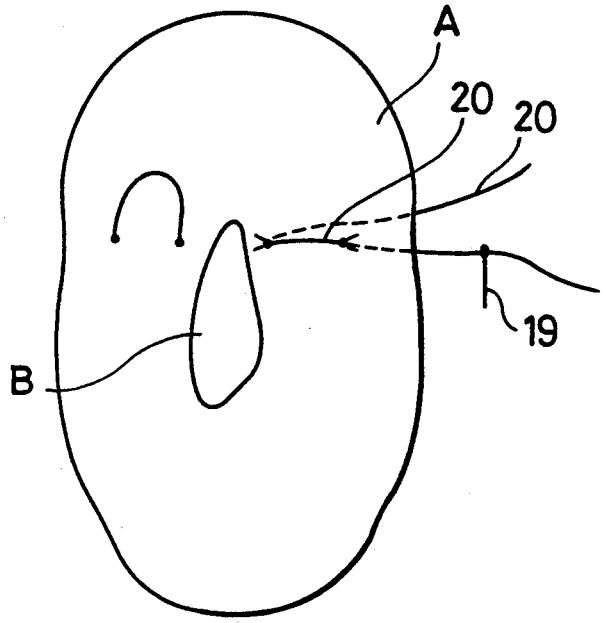
FIG. 12 includes explanatory views (a) and (b) showing a manner how to attach the eyes on the head base.
Figure 12:
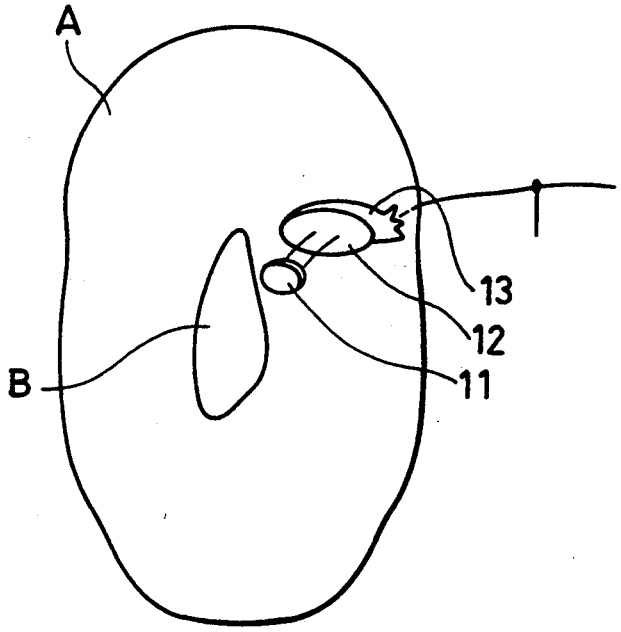

In the case of attaching a felt eye, as shown in (a) of FIG. 12, a needle 19 with a thread 20 is made to pass through the head base A from its backside to the face side, and then made to return to the backside of the head base A again. Then, the thread 20 is pulled so that a portion corresponding to the eye is made to be caved in. Then as shown in (b) of FIG. 12, the felt 13 for the white of the eye is bonded onto the caved portion, and the button 11 for a pupil is pulled by the thread so as to be fixed on the felt 13. The felt 12 for the eyelashes or eye lines is bonded on the felt 13 for the white of the eye.

The felt for the eyebrow is bonded so as to be harmonious with the position of the eye.

Figure 13:
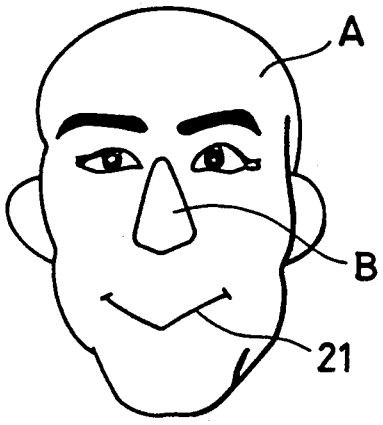
FIG. 13 is a front view of the head portion on which the hair member is not yet attached.

The position of the mouth is then determined . When the lips are to be attached, the face portion is pulled toward the back-side by the thread so as to agree with the shape of the lips to thereby form a caved portion. The felt for the lips is bonded onto this caved portion. In the case of stitch working for the mouth, as shown in FIG. 13, it will do to form outline stitches 21 at a predetermined position of the face portion of the head base A. Also in the time, similarly to the case of FIG. 11, it is preferable that the thread is made to pass through the head base A from its backside to its front side, and then made to return to the backside again while catching a bit of the cloth to thereby form caved portions at opposite end portions and a central portion of the lips.

Each ear is sewn at its circumference to the head base A along its transversal seam by vertical blind stitching.

Figure 14:
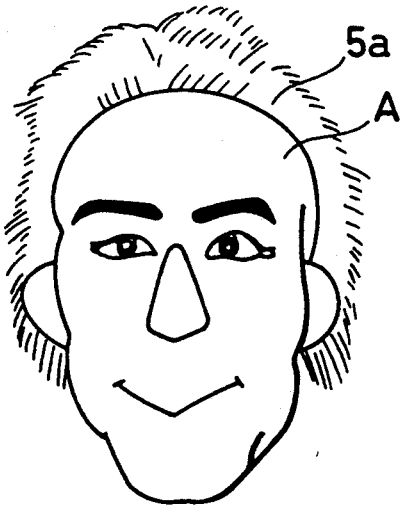
FIG. 14 includes front views (a) and (b) showing completed head portions respectively.
Figure 14:
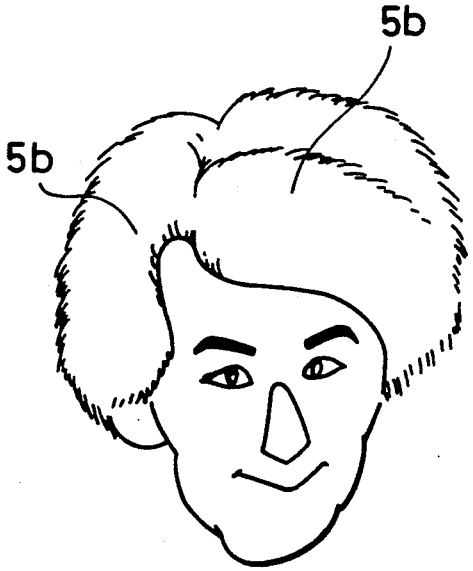

Then, the hair members **5*a* and 5*b* are attached. That is, as shown in (a) and (b) of FIG. 14, the hair members 5*a* and 5*b*** for constituting backside hair and fore-side hair are sewn to the head base A at its predetermined positions respectively. In this case, the inside of the hair members are suitably filled with stuffing. The hair portion is cut to finish it.

Figure 15:
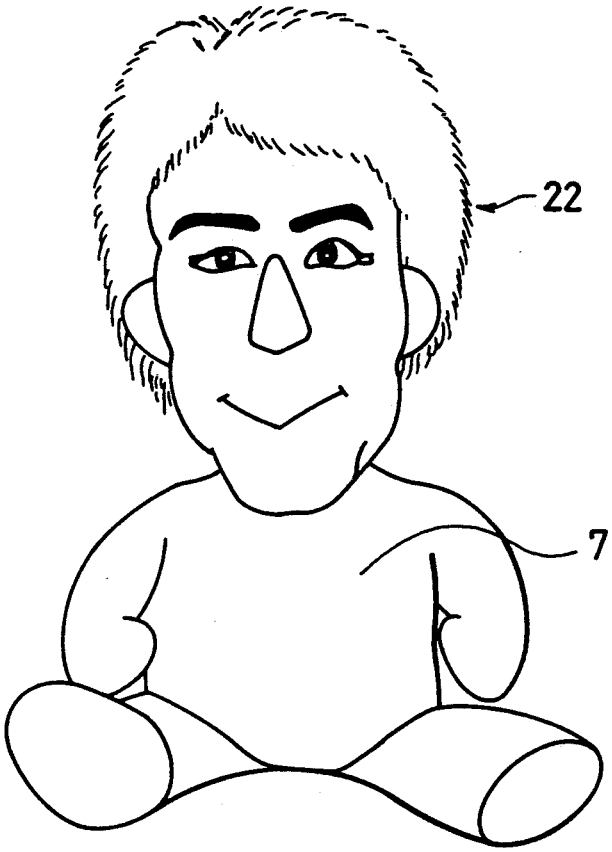
FIG. 15 is a front view showing a completed stuffed doll.

At last, the finished head portion 22 is sewn to the neck portion 10 of the body portion 7 as shown in FIG. 15, resulting in a stuffed doll completed. Clothes or the like may be suitably put on the body portion.

What is claimed is:

1. A method of producing a stuffed doll comprising the steps of:

forming elastic cloth such as rib stitch cloth, interlock stitch cloth or the like into a bag-like member;

inserting shaping members formed in shapes of a forehead and a chin into said bag-like member to its inside upper and lower portions respectively;

filling said bag-like member with stuffing to thereby form a head base having a predetermined shape;

fixing long-haired hair members, eyebrow members, eye members, a nose member, and a mouth member on said head base to thereby form a head portion; and fixing said head portion on a body portion.

2. A method of producing a stuffed doll according to claim 1, in which said shaping members are constituted by pad members respectively.

3. A method of producing a stuffed doll according to claim 1, in which each of said shaping members is formed to be bag-like so as to be filled with stuffing.

4. A method of producing a stuffed doll according to claim 1, in which each of said shaping member is constituted by an elastic body made of a rubber or plastic material.

5. A method of producing a stuffed doll according to claim 1, in which each of said eyebrow members is formed by cutting Magic Tape into a predetermined shape.

6. A method of making a stuffed doll according to claim 1, in which said nose member is formed through a process in which paper clay is used as a core material, said core material is covered with a shaping material of kapok, cotton, or the like, and then said shaping material is covered with a cloth material the same as that of said head base.

* * * * *